United States Patent [19]

Mizuno et al.

[11] Patent Number: 4,924,806

[45] Date of Patent: May 15, 1990

[54] DEVELOPING APPARATUS

[75] Inventors: Hiroshi Mizuno; Hiroshi Murasaki; Akihito Ikegawa; Kouichi Etou, all of Osaka, Japan

[73] Assignee: Minolta Camera Kabushiki Kaisha, Osaka, Japan

[21] Appl. No.: 145,816

[22] Filed: Jan. 19, 1988

[30] Foreign Application Priority Data

| | | | |
|---|---|---|---|
| Jan. 20, 1987 | [JP] | Japan | 62-12739 |
| Feb. 13, 1987 | [JP] | Japan | 62-32041 |
| Feb. 13, 1987 | [JP] | Japan | 62-32042 |
| Feb. 13, 1987 | [JP] | Japan | 62-32043 |

[51] Int. Cl.[5] ..... G03G 15/09; G03G 15/01

[52] U.S. Cl. ..... 118/658; 355/253; 355/326

[58] Field of Search ..... 355/3 DD, 4, 14 D; 118/645, 656, 657, 658

[56] References Cited

U.S. PATENT DOCUMENTS

| | | | |
|---|---|---|---|
| 4,089,601 | 5/1978 | Navone | 355/14 D |
| 4,378,158 | 3/1983 | Kanbe | 355/3 DD |
| 4,422,405 | 12/1983 | Kasahara et al. | 355/3 DD X |
| 4,570,570 | 2/1986 | Masham | 118/658 X |
| 4,615,606 | 10/1986 | Nishikawa | 355/3 |
| 4,652,115 | 3/1987 | Palm et al. | 355/4 X |
| 4,724,457 | 2/1988 | Abreu et al. | 355/3 DD |
| 4,746,951 | 5/1988 | Hayakawa et al. | 355/4 |
| 4,786,936 | 11/1988 | Ikegawa et al. | 355/3 DD |

FOREIGN PATENT DOCUMENTS

| | | | |
|---|---|---|---|
| 0131561 | 7/1985 | Japan | 355/4 |
| 61-201270 | 5/1986 | Japan . | |

*Primary Examiner*—A. T. Grimley
*Assistant Examiner*—Robert Beatty
*Attorney, Agent, or Firm*—Burns, Doane, Swecker & Mathis

[57] ABSTRACT

A developing apparatus is disposed adjacent to an electrostatic latent image support member in an image forming apparatus, and includes a rotatable developing sleeve confronting the electrostatic latent image support member, a magnetic roller disposed inside the developing sleeve for holding magnetic carrier on a peripheral surface of the developing sleeve, and a plurality of toner supply units confronting the developing sleeve for supplying toner to the developing sleeve. The magnetic roller accommodates a plurality of magnetic poles extending in a direction of its axis. Each toner supply unit is provided with a toner supply roller rotatable in contact with a magnetic brush held on the developing sleeve and a toner storing portion for storing the toner. A control device and an operation panel is also provided for selectively rotating either of the toner supply rollers by means of a driving source, for selecting the toner stored in any of the toner supply units, and for controlling the movement of the toner supply roller.

4 Claims, 3 Drawing Sheets

DEVELOPING APPARATUS

BACKGROUND OF THE INVENTION

1. Field of the Invention

The present invention generally relates to electrophotography and more particularly, to a developing apparatus for use in an image forming apparatus such as a copying apparatus or the like.

2. Description of the Prior Art

Conventionally, there has been proposed a multi-color copying apparatus, a multi-color printer or the like as one example of an image forming apparatus including electrophotographic copying means. Such an image forming apparatus is provided with a plurality of developing apparatus storing therein developer of several colors at the circumference of an electrostatic latent image support member or a photoreceptor drum, thereby reproducing an image formed on an original document, using several different colors.

However, at the circumference of the photoreceptor drum are disposed various kinds of appliances such as a charger, a cleaning device, an eraser and so on adjacent to one another. Because of this, the image forming apparatus generally used can accommodate only a few developing apparatuses adjacent to the photoreceptor drum.

If a large-sized photoreceptor drum is employed for the multi-color purpose, the image forming apparatus tends to become large. This fact goes against the recent demand for an apparatus of a small and compact size.

Japanese Patent Laid-open Application (Tokkaisho) No. 61-201271 discloses a multi-color developing apparatus of a small size. This developing apparatus is internally provided with a developing sleeve holding magnetic carrier on its peripheral surface, a cylindrical developer tank rotatably disposed at a side portion of the developing sleeve and the like. The inside of the developer tank is divided, in its several radial directions, into a plurality of compartments storing therein toner of several different colors. A plurality of toner supply and collecting rollers are rotatably disposed in respective openings formed at outside portions of the compartments so as to be able to confront the developing sleeve in the vicinity thereof.

In the above described developing apparatus, upon rotation of the developer tank, the toner supply and collecting roller in the developer compartment storing therein the toner of a specified color is caused to confront the developing sleeve so that the toner of the specified color may be supplied onto the developing sleeve. When the color of toner is changed, the toner held on the developing sleeve is initially collected into the developer compartment confronting it. Thereafter, upon rotation of the developer tank, the toner of another desired color is supplied from the developer compartment storing therein this toner onto the developing sleeve.

However, in the developing apparatus of the above described type in which the toner is supplied from the toner supply and collecting roller with respect to the carrier held on the developing sleeve, the toner can not be effectively supplied or collected unless a gap is accurately formed between the developing sleeve and the toner supply and collecting roller. Accordingly, the developing apparatus of this type is disadvantageous in that a mechanism for rotating the developer tank or for controlling its stop position becomes complicated.

Furthermore, when one of the developer compartments and one of the toner supply and collecting rollers confront the developing sleeve, one of the other compartments and rollers is located below. As a result, the toner often drops out of the developer compartment or from the surface of the roller. Such toner is liable to be supplied onto the developing sleeve upon rotation of the developer tank or to be collected into the developer compartment storing therein the toner of a different color, thus resulting in that two or more colors are disadvantageously mixed in a copied image.

Moreover, since the toner can not be replenished from a hopper or the like, the developer tank itself has to be detached from the developing apparatus for replenishment of the toner. Therefore, the apparatus of this type is disadvantageous in that the work for replenishing the toner becomes troublesome and the toner soils cloths or the human body.

This apparatus is also disadvantageous in that the color of toner can not be speedily changed, since it is necessary to rotate the developer tank in this occasion.

SUMMARY OF THE INVENTION

Accordingly, the present invention has been developed with a view to substantially eliminate the above described disadvantages inherent in the prior art developing apparatus, and has for its essential object to provide an improved developing apparatus in which toner can be readily and ensuredly supplied onto or collected from a developing sleeve rotatably disposed therein.

Another important object of the present invention is to provide a developing apparatus of the above described type capable of developing an image formed on an original document into a clear image of a specified color.

A further object of the present invention is to provide a developing apparatus of the above described type into which the toner can be readily replenished.

A still further object of the present invention is to provide a developing apparatus of the above described type in which the toner of a certain color can be speedily changed to that of another color as occasion demands.

In accomplishing these and other objects, according to one preferred embodiment of the present invention, there is provided a developing apparatus disposed adjacent to an electrostatic latent image support member in an image forming apparatus, the developing apparatus including a rotatable developing sleeve confronting the electrostatic latent image support member, a magnetic roller disposed inside the developing sleeve for holding magnetic carrier on a peripheral surface of the developing sleeve, a plurality of toner supply units confronting the developing sleeve for supplying toner thereto, a first means for selectively rotating either of the toner supply rollers, a. second means for selecting either of the toner stored in the toner supply units, and a third means for controlling the toner supply roller in compliance with a signal sent from the second means.

The aforementioned magnetic roller accommodates a plurality of magnetic poles extending in a direction of its axis.

Each toner supply unit is provided with a toner supply roller rotatable in contact with a magnetic brush held on the developing sleeve and a toner storing portion for storing the toner therein.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and in which.

DESCRIPTION OF THE PREFERRED EMBODIMENT

Figure 1:
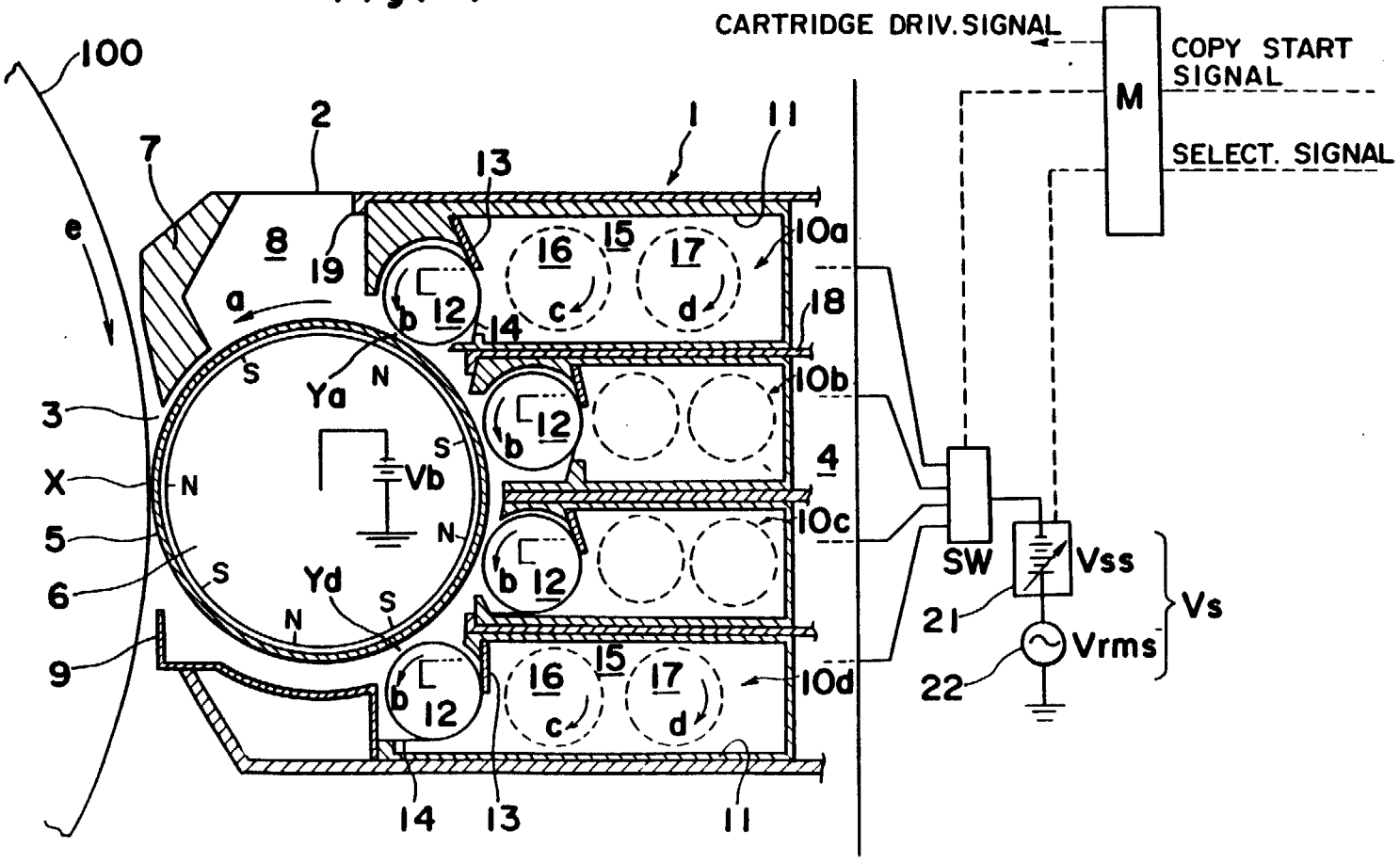
FIG. 1 is a cross sectional view of a developing apparatus according to one preferred embodiment of the present invention.

Referring now to the drawings, there is shown in FIG. 1, a developing apparatus 1 according to one preferred embodiment of the present invention, which is provided with a housing 2, a rotatably arranged developing sleeve 5, and a fixedly arranged magnetic roller 6 or the like. The housing 2 is of a frame in the shape of a box and defines openings 3 and 4 at its front and rear portions, respectively.

The developing sleeve 5 is rotatable in a direction as shown by an arrow (a) at the front portion of the housing 2 and is opposed to an electrostatic latent image support member or a photoreceptor drum 100 at a predetermined interval, with developing bias voltage Vb being applied to the developing sleeve 5. The magnetic roller 6 is fixedly disposed inside the developing sleeve 5 and accommodates, along its periphery, a plurality of magnets extending in its axial direction.

The housing 2 is further internally provided with a bristle height adjusting member 7 confronting the developing sleeve 5 and a toner scattering preventing plate 9 respectively formed at upper and lower portions of the opening 3. A developer storing portion 8 for storing therein the developer is formed behind the bristle height adjusting member 7 and above the developing sleeve 5.

A plurality of, for example, four toner cartridges 10*a* to 10*d* of substantially the same construction are detachably mounted in a rear portion of the housing 2. Each toner cartridge 10*a* to 10*d* has a casing 11 in the shape of a box accommodating a toner supply and collecting roller 12 (referred to as a toner supply roller 12 hereinafter), a scraper 13, a toner return preventing film 14 and the like. The toner supply roller 12 is disposed rotatably in a direction as shown by an arrow (b) in an opening defined at a front portion of the casing 11. A large number of fine concaves are formed on the entire peripheral surface of the toner supply roller 12. The scraper 13 and the toner return preventing film 14 are both kept in pressure contact with the toner supply roller 12.

A toner hopper 15 is formed at a rear portion of the casing 11 and accommodates a couple of toner transport vanes 16 and 17 which are rotatable in directions as shown by arrows (c) and (d), respectively.

The toner cartridges 10*a*, 10*b*, 10*c* and 10*d* having the above described construction are located in the housing 2 in this order from the top towards the bottom. As many guide members 18 and stoppers 19 as toner cartridges 10*a* to 10*d* are provided in the housing 2 at locations where respective toner cartridges 10*a* to 10*d* are positioned so that each toner cartridge may be readily and independently mounted in or dismounted from the housing 2 through the opening 4 and placed in its desired position in the housing 2 with an outer periphery of each roller 12 located a predetermined distance from an outer periphery of the sleeve 5. When the toner cartridges 10*a* to 10*d* are placed in position in the housing 2, not only a predetermined gap is ensuredly defined between the developing sleeve 5 and each toner supply roller 12, but also the toner supply rollers 12 are caused to face respective magnetic poles securely mounted in the magnetic roller 6. Furthermore, in this event, the toner supply rollers 12 and the toner transport vanes 16 and 17 are coupled to corresponding driving sources provided for respective toner cartridges 10*a* to 10*d*.

Collecting bias voltage Vs obtained by connecting DC (direct current) bias voltage Vss and AC (alternating current) bias voltage Vrms in series is selectively applied to any one of the toner supply rollers 12 through a switch SW. The DC and AC bias voltage Vss and Vrms are outputted from a DC power source 21 and an AC power source 22, respectively. The voltage outputted from the DC power source 21 is rendered variable by a signal sent from a control device M of a micro-computer as shown in Table 1, depending on working conditions of the developing apparatus 1. It is to be noted that the frequency of the AC bias voltage Vrms is desirably set within the range of 100 to 400 Hz.

TABLE 1

| Working Conditions | Developing Bias (Vb) | Collecting Bias (Vs) | |
|---|---|---|---|
| | | DC (Vss) | AC (Vrms) |
| At Starting | −150 V | −200 V | 700 V |
| At Develop. | −150 V | −300 V | 700 V |
| At Collect. | −150 V | −350 V | 700 V |

The developer employed in the aforementioned developing apparatus 1 is a two-component developer consisting of toner and magnetic carrier which are so selected that the former and the latter may be electrically charged with the positive and negative polarity, respectively, upon friction therebetween. The carrier is magnetically held on the outer peripheral surface of the developing sleeve 5, whereas several kinds of differently colored toner are stored in respective hoppers 15 of the toner cartridges 10*a* to 10*d*.

Figure 2:
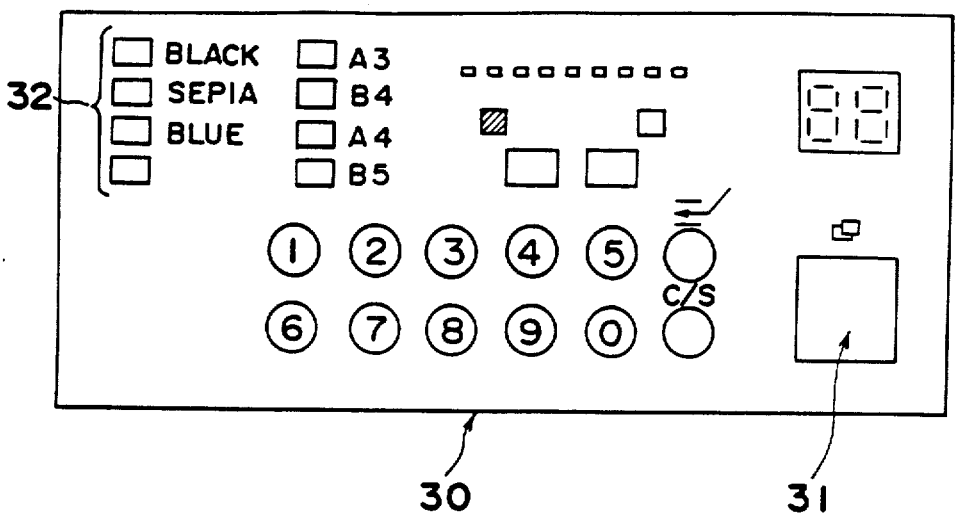
FIG. 2 is a top plan view of an operation panel for operating an image forming apparatus employing therein the developing apparatus of FIG. 1.

Under the above described circumstances, the explanation will be made hereinafter with respect to the working of the developing apparatus 1 at the time of starting (a), development (b) and collecting (c), in the case where a certain color of the toner stored in the topmost toner cartridge 10*a* is selected by a color selection switch 32 provided on an operation panel 30 of a copying apparatus. FIG. 2 illustrates one example of the operation panel 30 of the copying apparatus.

(a) At the time of starting:

When a print switch 31 has been turned on, the DC bias voltage Vss is set to −200 V by a signal sent from the control device M, and also, the collecting bias voltage Vs obtained by adding the AC bias voltage (700 V) to the DC bias voltage (−200 V) is applied to the toner supply roller 12 of the toner cartridge 10a through the switch SW. At the same time, the developing bias voltage (Vb = −150 V) is applied to the developing sleeve 5.

Thereafter, when the driving source (not shown) has been turned on, the developing sleeve 5, the toner supply roller 12 of the toner cartridge 10a and the toner transport vanes 16 and 17 start rotating in the directions of the arrows (a), (b), (c) and (d), respectively. In this event, the toner supply rollers 12 and the toner transport vanes 16 and 17 of the other toner cartridges 10b to 10d are kept at a standstill.

As a result, a mass of toner is scattered upon rotation of the toner transport vanes 16 and 17 within the hopper 15 of the toner cartridge 10a so that the toner may be successively transported forwards to be caught in the fine concaves formed on the external surface of the toner supply roller 12 upon rotation thereof.

When passing the scraper 13, the toner held on the surface of the toner supply roller 12 is preliminarily electrically charged with the positive polarity upon frictional contact with the toner supply roller 12 so that a thin layer of the electrically charged toner may be formed thereon. In this event, an excessive amount of the toner is scraped by the scraper 13.

When the toner in the form of the thin layer has reached a toner supply region Ya confronting the developing sleeve 5 upon rotation of the toner supply roller 12, the toner is transferred onto the surface of the developing sleeve 5 by virtue of an effect of the carrier held thereon for catching the toner.

The toner is then transported in the direction of the arrow (a) upon rotation of the developing sleeve 5 and is mixed with the carrier so that the toner and the carrier can be electrically charged with the positive and negative polarity respectively, upon friction therebetween.

When the developer has been introduced into the developer storing portion 8 formed behind the bristle height adjusting member 7, the majority of the developer is blocked by the bristle height adjusting member 7 and is then directed upwards along it, since the developer which has reached the bristle height adjusting member 7 is pushed by other developer following it. Thereafter, the developer drops onto the developing sleeve 5 to be held thereon again. That is, the developer is stirred to be desirably mixed in the developer storing portion 8, while forming an eddy in the clockwise direction. The two-component developer is thus adjusted to be raised in electric potential up to a level suitable for the development.

A portion of the developer satisfactorily mixed and adjusted in the aforementioned manner passes between the bristle height adjusting member 7 and the developing sleeve 5 to form magnetic brushes, which pass a developing region X confronting the photoreceptor drum 100. Thereafter, when the magnetic brushes have reached the toner supply region Ya confronting the toner supply roller 12, they catch the toner held on the toner supply roller 12 again, and thus, toner density on the developing sleeve 5 gradually increases.

Hereupon, since not only the DC bias voltage Vss but the AC bias voltage Vrms are applied to the toner supply roller 12, the toner is electrostatically held on the surface of the toner supply roller 12 in compliance with a bias voltage difference between the toner supply roller 12 and the developing sleeve 5. However, as the bias voltage difference fluctuates in accordance with a periodic change of the AC bias voltage Vrms, electrostatic holding force for holding the toner on the toner supply roller 12 also periodically fluctuates.

Accordingly, the toner held on the toner supply roller 12 is frequently brought into contact with the carrier and the magnetic brushes to be effectively caught thereby so that the toner density on the developing sleeve 5 rapidly increases.

In the toner supply region Ya, when the toner is supplied onto the developing sleeve 5, it is simultaneously transferred or collected onto the toner supply roller 12 from the developing sleeve 5. However, since the amount of toner to be supplied is greater than that to be collected until the toner density on the developing sleeve 5 becomes a certain value determined in accordance with the bias voltage difference between the developing bias Vb and the collecting bias Vs, the toner density on the developing sleeve 5 increases during this period.

Upon lapse of a certain period after the depression of the print switch 31, the amount of toner supplied is balanced with that of toner collected and the toner density on the developing sleeve 5 keeps the constant value. In this instance, the DC bias voltage Vss is switched from −200 V to −300 V by a signal sent from the control device M.

As a result, the toner electrically charged with the positive polarity on the developing sleeve 5 is slightly electrostatically transferred or collected onto the toner supply roller 12 and the toner density on the developing sleeve 5 slightly decreases. The toner density on the developing sleeve 5 is, however, desirably maintained in accordance with the bias voltage difference between the two.

(b) At the time of development:

On condition that the developer on the developing sleeve 5 has been adjusted to a constant density in the above described manner, and when an electrostatic latent image formed on the photoreceptor drum 100 with image portion charged to −600 V and exposed by an optical system approaches the developing region X in a direction as shown by an arrow (e) so as to be brought into frictional contact with the magnetic brushes held on the developing sleeve 5, the electrostatic latent image turns to a visible image by electrostatically catching the toner.

The visible toner image is transferred onto a copy paper sheet in a subsequent transfer process (not shown). Upon successive rotation of the developing sleeve 5 in the direction of the arrow (a), the toner is newly uniformly replenished onto the surface of the developing sleeve 5 at the developer storing portion 8 so that a pattern of the toner which has been consumed in the developing region X may be erased.

In the toner supply region Ya, the toner is supplied onto the surface of the developing sleeve 5 by an amount corresponding to the amount consumed for the development so that the toner density on the surface of the developing sleeve 5 may be kept constant.

(c) At the time of collecting:

Upon completion of the development, the DC bias voltage Vss in the collecting bias voltage Vs is switched from −300 V to −350 V by virtue of a signal sent from the control device M. Because of this, the toner charged with the positive polarity on the developing sleeve 5 undergoes greater influence of electrical attraction caused by the toner supply roller 12 than that caused by the carrier held on the developing sleeve 5. The balance between the toner supplied and that collected is, therefore, lost in the toner supply region Ya and the toner on the developing sleeve 5 is transferred or collected onto the surface of the toner supply roller 12.

Since the collecting bias voltage Vs includes the AC voltage in series in addition to the DC voltage, the toner on the developing sleeve 5 is subjected to periodically fluctuating electrical attraction of the toner supply roller 12. Accordingly, the attraction between the toner and the carrier is remarkably weakened so that the toner may be rapidly collected onto the toner supply roller 12.

The toner collected is transported in the direction of the arrow (b) while being electrostatically held on the surface of the toner supply roller 12. Then, the toner passes the toner return preventing film 14, and the scraper 13 mechanically scrapes down the toner which has entered the hopper 15 so that the toner may be stored again therein.

In this occasion, the toner held in the fine concaves on the surface of the toner supply roller 12 is not scraped by, but passes the scraper 13 to be transported in the toner supply region Ya. Such toner, however, will not be supplied onto the surface of the developing sleeve 5 again due to the presence of the bias voltage difference between the developing bias Vb and the collecting bias Vs.

As a result, the toner is wholly collected from the surface of the developing sleeve 5 into the hopper 15 of the toner cartridge **10*a*. Thus, the developing sleeve 5 is brought into a state in which it carries only the carrier on its surface. Upon lapse of a predetermined period after completion of the development, the collecting bias voltage Vs is turned off by a signal from the control device M so that the toner supply roller 12 and the toner transport vanes 16 and 17** are brought to a stop.

When the color of the toner stored in the lowermost toner cartridge **10*d* is selected by the color selection switch 32, the control device M having received a signal from the color selection switch 32 connects the collecting bias voltage Vs to the toner supply roller 12 of the toner cartridge 10*d*** by changing over the switch SW.

In this state, when the print switch 31 is turned on, the toner is supplied from the toner cartridge **10*d*** so that the development as described above may be executed.

At this moment, since the developing sleeve 5 carries nothing but the carrier and all the toner used in the previous development has been collected into the toner cartridge **10*a*, there never occurs such a situation that a mixture of the toner of different colors produced on the developing sleeve 5 turns the electrostatic latent image formed on the photoreceptor drum 100** into a copied image mixed in color.

When the toner needs to be replenished into any desired toner cartridge **10*a* to 10*d*, the corresponding toner cartridge is initially dismounted from the housing 2 through the opening 4 defined on the rear side thereof. Upon opening of a cover (not shown), the suitable toner is replenished and the toner cartridge is replaced on its previous location in the housing 2**.

In this event, since the casing 11 of the toner cartridge is brought into contact with the stopper 19 of the housing 2, the toner supply roller 12 is spaced from the developing sleeve 5 at a required interval. Thus, even when the toner cartridge is mounted in or dismounted from the housing 2, it is possible to keep the conditions required for the development constant.

The toner has an electrically charging characteristic or the property of being electrified, different depending upon its color.

Figure 5:
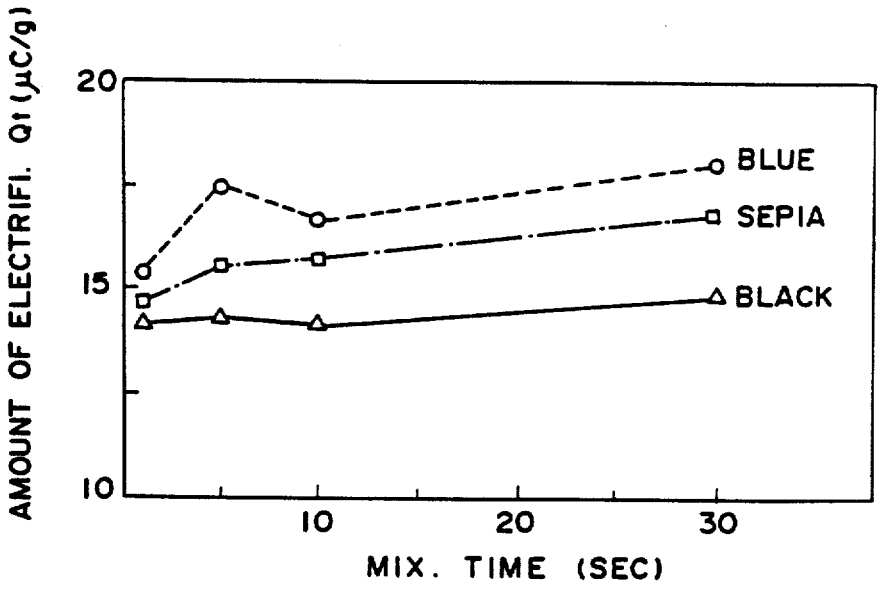
FIG. 5 is a graph showing the property of electrically charging the toner in several colors.

In connection with this fact, an experiment has been made on condition that three kinds of black, sepia and blue toner are respectively mixed at a rate of 7.5 wt% with the carrier and agitated therewith uniformly. According to this experiment and as illustrated in FIG. 5, it has been found out that the black toner approaches a saturated amount of electrification within a short mixing time and the blue toner does so after a long mixing time. In other words, the black toner is most superior and the blue toner is most inferior in electrically charging characteristic. Composition of the toner used in the experiment is shown in the following table.

| | | Composition of Toner | | |
|---|---|---|---|---|
| | | Black | Sepia | Blue |
| Resin (styrene-acrylic resin) | | 100 | 100 | 100 |
| Dye (nigrosine dye) | | 4 | — | — |
| Carbon Black | | 4 | — | — |
| Wax (low-molecular-weight polypropylene, Biscol 330P) | | 2 | 3.5 | 3.5 |
| Charge Adjustor (quaternary ammonium salt, P-51) | | — | 4 | 4 |
| Pig-ment | lake red C | — | 2 | — |
| | copper-phthalocyanine | — | 0.5 | 5 |
| | benzidine-fellow | — | 3 | — |
| Post-treat. | silica treatment (R-976) | 0.1 wt % | 0.075 wt % | 0.05 wt % |

On the other hand, in the aforementioned developing apparatus 1, the toner cartridge **10*d* is located upstream from the toner cartridge 10*a* in a direction of rotation of the developing sleeve 5 as shown by the arrow (a). A distance from the toner supply region Yd of the former up to the developing region X via the developer storing portion 8 is, therefore, longer than that from the toner supply region Ya of the latter. As a result, the toner supplied from the toner cartridge 10*d* is kept in frictional contact with the carrier for a longer period than is that from the toner cartridge 10*a***.

Accordingly, the blue toner which is inferior in electrically charging characteristic and supplied from the toner cartridge **10*d* onto the developing sleeve 5 passes a plurality of locations confronting the magnetic poles and does not reach the developer storing portion 8 until a longer period of time elapses, as compared with the black toner located downstream. In this event, the blue toner passes through a plurality of small gaps formed between the developing sleeve 5 and the toner supply rollers 12 and this fact causes disturbance of the developer. Thus, the blue toner frequently gets in contact with the carrier on the developing sleeve 5** for a relatively longer period to be raised in electric potential.

The blue toner is further electrically charged up to a level suitable for the development through the mixing and agitating action in the developer storing portion 8 and is, therefore, transported to the developing region X in fully electrically charged conditions. Consequently, it is possible to prevent the occurrence of toner powder following poor electrification, the occurrence of fog or the like.

The black toner which is superior in electrically charging characteristic and supplied from the toner cartridge **10*a* onto the developing sleeve 5** is rapidly and readily electrically charged and does not need much time until it obtains the saturated amount of electrification. Accordingly, even when the toner cartridge 10a is located close to the developer storing portion 8, it is possible to provide the black toner with sufficient electric potential.

If three kinds of black, sepia and blue toner are employed in the developing apparatus 1 according to the present invention, it is necessary to store the blue toner in the toner cartridge 10d located the most upstream, the black toner in the toner cartridge 10a located the most downstream and the sepia toner in either of the two toner cartridges 10b or 10c located between the toner cartridges 10a and 10d.

Figure 3:
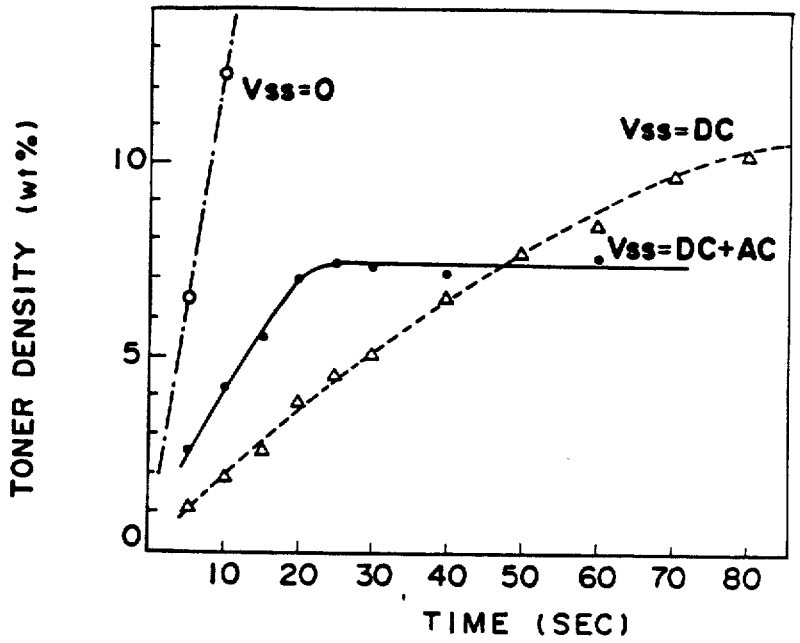
FIG. 3 is a graph showing the property of supplying toner.

FIG. 3 illustrates a graph showing toner density changing with time on the developing sleeve 5 in three cases: the case in which the collecting bias voltage Vs obtained by connecting DC and AC bias voltages in series is applied to the toner supply roller 12; the case in which the collecting bias voltage Vs applied to the toner supply roller 12 is rendered to be 0 V; and the case in which only the DC voltage is applied as the collecting bias voltage Vs to the toner supply roller 12. The property of supplying the toner onto the developing sleeve 5 can be readily understood from the graph of FIG. 3.

More specifically, in the case where the collecting bias voltage Vs is 0 V, the toner density on the developing sleeve 5 goes on rapidly increasing and gets out of control. In the case where only the DC voltage is applied, the toner density goes on gradually increasing and can not be kept constant. This case is, however, not so extreme as the case in which Vs equals 0 V. On the contrary, in the case where the AC voltage connected to the DC voltage in series is employed as the collecting bias voltage Vs, the toner density increases earlier than the case in which only the DC voltage is applied. Furthermore, in this case, the toner density is kept substantially constant at a certain level where the amounts of toner to be supplied and collected are well balanced.

Figure 4:
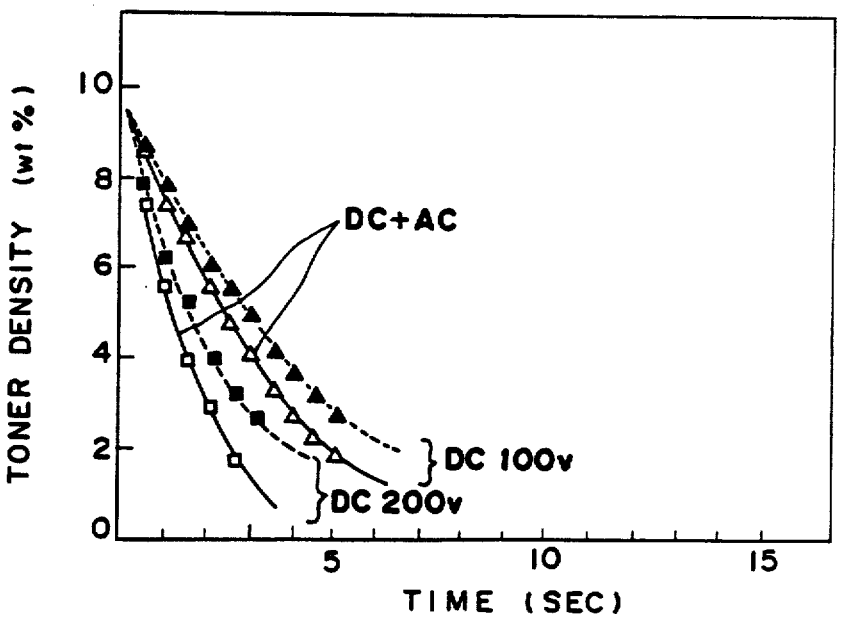
FIG. 4 is a graph showing the property of collecting the toner.

FIG. 4 illustrates another graph showing the toner density changing with time on the toner supply roller 12 in two cases: the case in which the collecting bias voltage Vs obtained by connecting DC and AC bias voltages in series is applied to the toner supply roller 12; and the case in which only the DC voltage is applied as the collecting bias voltage Vs to the toner supply roller 12. The property of collecting the toner from the developing sleeve 5 onto the toner supply roller 12 can be readily understood from the graph of FIG. 4.

FIG. 4 teaches that the toner on the developing sleeve 5 is collected onto the toner supply roller 12 more rapidly in the case where the AC voltage connected to the DC voltage in series is employed as the collecting bias voltage Vs than in the case where only the DC voltage is employed.

According to the above described experiments, in the developing apparatus 1 of the present invention in which the AC voltage connected to the DC voltage in series is employed as the collecting bias voltage Vs applied to the toner supply roller 12, the toner on the toner supply roller 12 can be rapidly supplied onto the developing sleeve 5 so that not only the toner density on the developing sleeve 5 may be rapidly raised up to a predetermined one but also the toner density at the time of development may be steadily maintained. In addition, at the time of collecting, the toner on the developing sleeve 5 can be rapidly collected onto the toner supply roller 12.

It is to be noted here that in the foregoing embodiment, although the toner is replenished into the toner cartridges 10a to 10d upon removal thereof, a toner supply port may be formed in each toner cartridge 10a to 10d so that the toner can be replenished into any desired toner cartridge 10a to 10d from a toner hopper by way of the toner supply port. In this case, it is not necessary to remove the toner cartridges 10a to 10d whenever the toner is replenished thereinto, thus resulting in that the replenishment of the toner can be readily and simply executed.

It is also to be noted that in the foregoing embodiment, although the toner on the developing sleeve 5 is collected into the hopper 15 whenever the development is completed, the toner may be collected only in the case where the color of toner is changed by the color selection switch. However, if the toner is collected after each development, as in the foregoing embodiment, the properties of the toner are advantageously kept normal even when the developing apparatus 1 is not used for a long period.

It is further to be noted that in the above described embodiment, although the toner cartridges 10a to 10d store therein the toner of several different colors, the black toner to be frequently used may be stored in the toner cartridges 10a and 10b located on the upper side of the housing 2, with the toner of different colors being stored in the toner cartridges 10c and 10d located on the lower side.

From the foregoing, the developing apparatus of the present invention is provided with a plurality of toner cartridges each accommodating the toner supply and collecting roller confronting the developing sleeve at the periphery thereof. The toner is supplied from each toner cartridge onto the surface of the developing sleeve and collected from the latter into the former.

A gap defined between each toner supply and collecting roller and the developing sleeve is always kept constant and the toner can be, therefore, steadily supplied and collected so that an image with substantially unchanging density may be obtained.

The toner cartridge employed in the present invention has a simple construction, since it can be mounted in or dismounted from the housing of the developing apparatus without any necessity of a complicated mechanism.

Furthermore, the toner supply and collecting roller always confronts the developing sleeve at a certain interval. The toner, therefore, hardly spills out of the toner cartridge or the toner supply and collecting roller and scarcely soils the inside of the image forming apparatus internally provided with the developing apparatus of the present invention. In addition, not only the toner of a certain color is hardly mixed with that of another color in the developing apparatus or in the housing thereof, but also the former is not collected into the toner cartridge storing therein the latter, thus resulting in that the image obtained is never mixed in two or more colors.

If the toner is replenished into any desired toner cartridge upon removal thereof or by way of a hopper, the replenishment can be readily and simply conducted and the toner never soils cloths or the human body.

Furthermore, since the collecting bias voltage applied at the time of changing the color of toner is lower than that applied at the time of development, the toner supplied is greater than the toner collected. Because of the fact that the alternating current voltage is added to the collecting bias voltage, the electrostatic force of the toner for holding it on the toner supply roller periodically fluctuates under the influence of the periodically changing collecting bias voltage, thus promoting the supply of the toner onto the developing sleeve so that the supply efficiency may be raised.

Accordingly, when the color of toner is changed, the toner is rapidly and effectively supplied onto the developing sleeve. The developing apparatus of the present invention is further advantageous in that the toner density rapidly reaches its predetermined level and the developing speed can, therefore, be rendered speedy.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A developing apparatus adjacent to an electrostatic latent image support member in an image forming apparatus, said developing apparatus comprising:

a rotatable developing sleeve confronting the electrostatic latent image support member;

a magnetic roller disposed inside said developing sleeve for holding magnetic carrier in a brush form on a peripheral surface of said developing sleeve, said magnetic roller accommodating a plurality of magnetic poles extending in a direction of its axis;

a plurality of toner supply units including a plurality of rotatable toner supply rollers, each of said toner supply units simultaneously confronting said developing sleeve for supplying toner thereto and including, a respective one of said toner supply rollers arranged with respect to said developing sleeve so as to have a predetermined gap therebetween, said toner supply roller being in contact with a magnetic brush formed on the developing sleeve, a toner storing portion for storing the toner therein;

means for selecting one of said toner supply units which stores the toner to be used;

a first means for selectively rotating a selected one of said toner supply rollers located in the toner supply unit selected by the selecting means;

a second means for forming a predetermined potential difference between said developing sleeve and said selected toner supply roller while said selected toner supply roller rotates during a developing operation when toner applied to the developing sleeve is transferred to the electrostatic latent image support member; and a third means for controlling said first means and said second means in compliance with a selection by said selecting means wherein said second means includes means for applying a predetermined bias voltage to said developing sleeve and means for selectively applying direct current voltage to one of said toner supply rollers in compliance with the selection by said selecting means, further comprising means for controlling the direct current voltage applying means so that the amount of the direct current voltage applied to said toner supply roller changes during a predetermined period immediately prior to the beginning of development, wherein said controlling means changes the amount of the direct current voltage applied to the toner supply roller from a first negative value to a second negative value, the first value being closer to zero than the second value.

2. A developing apparatus as claimed in claim 1, wherein said controlling means changes the amount of the direct current voltage applied to the toner supply roller from the second negative value to a third negative value upon the completion of development, the second value being closer to zero than the third value.

3. A developing apparatus adjacent to an electrostatic latent image support member in an image forming apparatus, said developing apparatus comprising:

a rotatable developing sleeve confronting the electrostatic latent image support member;

a magnetic roller disposed inside said developing sleeve for holding magnetic carrier in a brush form on a peripheral surface of said developing sleeve, said magnetic roller accommodating a plurality of magnetic poles extending in a direction of its axis;

a plurality of toner supply units including a plurality of rotatable toner supply rollers, each of said toner supply units simultaneously confronting said developing sleeve for supplying toner thereto and including, a respective one of said toner supply rollers arranged with respect to said developing sleeve so as to have a predetermined gap therebetween, said toner supply roller being in contact with a magnetic brush formed on the developing sleeve, a toner storing portion for storing the toner therein, means for selecting one of said toner supply units which stores the toner to be used;

a first means for selectively rotating a selected one of said toner supply rollers located in the toner supply unit selected by the selecting means;

a second means for forming a predetermined potential difference between said developing sleeve and said selected toner supply roller while said selected toner supply rotates during a developing operation when toner applied to the developing sleeve is transferred to the electrostatic latent image support member; and a third means for controlling said first means and said second means in compliance with a selection by said selecting means wherein said second means includes means for applying a predetermined bias voltage to said developing sleeve and means for selectively applying direct current voltage to one of said toner supply rollers in compliance with the selection by said selecting means, further including means for controlling the direct current voltage applying means so that the amount of the direct current voltage applied to said toner supply roller changes during a predetermined period immediately prior to the beginning of development, wherein said controlling means changes the amount of direct current voltage applied to the toner supply roller from a first value to a second value during the predetermined period immediately prior to the beginning of development and then from the second value to a third value upon the completion of development and during a period of toner recovery, the first value being closer to zero than the second and third values and the second value being closer to zero that the third value.

4. A developing apparatus adjacent to an electrostatic latent image support member in an image forming apparatus, said developing apparatus comprising:

a rotatable developing sleeve confronting the electrostatic latent image support member;

a magnetic roller disposed inside said developing sleeve for holding magnetic carrier in a brush form on a peripheral surface of said developing sleeve, said magnetic roller accommodating a plurality of magnetic poles extending in a direction of its axis;

toner supply means for supplying the toner onto said developing sleeve including, a housing provided with a plurality of casings, each of the casings storing therein a toner, said casings being located one above another in a stacked arrangement in said housing;

a plurality of toner supply rollers, each of which is provided in a respective one of said casings, each of said toner supply rollers being arranged with respect to said developing sleeve so as to have a predetermined gap therebetween and being rotatable in contact with the magnetic brush held on said developing sleeve;

means for selecting one of said casings which stores a toner to be used;

a first means for selectively rotating a respective one of said toner supply rollers located in the casing selected by the selecting means;

a second means for forming a predetermined potential difference between said developing sleeve and said selected toner supply roller; and a third means for controlling said first means and said second means in compliance with a selection by said selecting means, wherein said second means includes means for applying predetermined bias voltage to the developing sleeve and means for selectively applying direct current voltage to one of the toner supply rollers in compliance with the selection by the selecting means, the developing apparatus further including means for controlling the direct current voltage applying means so that the amount of the direct current voltage applied to said toner supply roller changes, and said controlling means changing the amount of direct current voltage applied to the toner supply roller from a first value to a second value during the predetermined period immediately prior to the beginning of development and then from the second value to a third value upon the completion of development and during a period of toner recovery, the first value being closer to zero than the second and third values and the second value being closer to zero than the third value.

* * * * *